US009339139B2

(12) United States Patent
Harman

(10) Patent No.: US 9,339,139 B2
(45) Date of Patent: May 17, 2016

(54) APPARATUS AND METHOD FOR ATTACHING AN ORNAMENTAL TREE TOP FIXTURE

(71) Applicant: Thomas M. Harman, Portola Valley, CA (US)

(72) Inventor: Thomas M. Harman, Portola Valley, CA (US)

( * ) Notice: Subject to any disclaimer, the term of this patent is extended or adjusted under 35 U.S.C. 154(b) by 52 days.

(21) Appl. No.: 14/295,750

(22) Filed: Jun. 4, 2014

(65) Prior Publication Data

US 2014/0287168 A1 Sep. 25, 2014

Related U.S. Application Data

(63) Continuation-in-part of application No. 13/207,706, filed on Aug. 11, 2011.

(51) Int. Cl.
*A47G 33/10* (2006.01)
*A47G 33/08* (2006.01)

(52) U.S. Cl.
CPC ..... *A47G 33/08* (2013.01); *A47G 33/10* (2013.01); *A47G 2033/089* (2013.01); *Y10T 29/49826* (2015.01)

(58) Field of Classification Search
CPC ..... A47G 2033/089; A47G 33/10
See application file for complete search history.

(56) References Cited

U.S. PATENT DOCUMENTS

| | | | | | |
|---|---|---|---|---|---|
| 1,510,230 | A * | 9/1924 | Johnston | A47G 33/08 | 362/121 |
| 1,543,424 | A * | 6/1925 | Cowles | A47G 33/08 | 362/121 |
| 2,784,529 | A * | 3/1957 | Prestigiacomo | A47G 33/0881 | 239/55 |
| 4,214,023 | A * | 7/1980 | Day | A47G 33/08 | 428/102 |
| 4,462,065 | A | 7/1984 | Rhodes | | |
| 5,071,098 | A * | 12/1991 | Aldridge | A47F 5/04 | 248/219.2 |
| 5,085,901 | A | 2/1992 | Johnson et al. | | |
| 5,243,782 | A * | 9/1993 | Jones | A01G 27/00 | 47/40.5 |
| 6,037,021 | A | 3/2000 | Koo | | |
| 2004/0212997 | A1* | 10/2004 | Ballarini | A45B 3/04 | 362/249.01 |
| 2010/0096526 | A1* | 4/2010 | Richardson | A47G 33/08 | 248/231.81 |
| 2013/0313213 | A1* | 11/2013 | Ellison | A47B 87/0223 | 211/144 |
| 2015/0017382 | A1* | 1/2015 | Forbes | A47G 33/10 | 428/99 |

* cited by examiner

*Primary Examiner* — Gary Hoge
(74) *Attorney, Agent, or Firm* — Tarolli, Sundheim, Covell & Tummino LLP

(57) ABSTRACT

An apparatus can include an elongated shaft having a distal end and a proximal end. An ornamental fixture can be attached to and extend outwardly from the distal end of the elongated shaft. A connector at the proximal end of the elongated shaft is configured to secure the elongated shaft to a tree, such as to support the ornamental fixture in a desired position relative to the tree.

11 Claims, 3 Drawing Sheets

APPARATUS AND METHOD FOR ATTACHING AN ORNAMENTAL TREE TOP FIXTURE

RELATED APPLICATION

This application is a continuation-in-part application of co-pending U.S. application Ser. No. 13/207,706 filed Aug. 11, 2011, and entitled APPARATUS AND METHOD FOR ATTACHING A DECORATIVE FIXTURE TO A TREE TOP, the entirety of which is incorporated herein by reference.

TECHNICAL FIELD

This disclosure relates to an apparatus and method for attaching an ornamental fixture to the top of a tree.

BACKGROUND

There are various types of decorations that people place on the top of trees and, in particular, on top of Christmas trees. It can be difficult, however, to place and maintain the decoration on the top of the tree in a desired orientation. More specifically, due to several factors such as space constraints, deterioration of the decorative tree topper over time, and the tree top geometry, it may be difficult to place or maintain the tree topper in the desired location atop the tree.

SUMMARY

This disclosure relates to an apparatus and method for attaching an ornamental fixture to the top of a tree.

As one example, an apparatus can include an elongated shaft having a distal end and a proximal end. An ornamental fixture can be attached to and extend outwardly from the distal end of the elongated shaft. A connector at the proximal end of the elongated shaft is configured to secure the elongated shaft to a tree, such as to support the ornamental fixture in a desired position relative to the tree.

As yet another example, a method can be performed to secure the apparatus to a top of a tree. The method can include placing the distal end of the elongated shaft and the connector adjacent a branch of the tree, and attaching the connector to the branch of the tree to secure the ornamental fixture at a desired position relative to a top of the tree.

DETAILED DESCRIPTION

This disclosure is directed to a tree topper apparatus and method for attaching an ornamental fixture to the top of a tree. The tree topper can have any two- or three-dimensional ornamental design, such as a star, a present, an angel, an animal or the like, which an individual might wish to place atop a tree. The apparatus can be attached to the top of a real or artificial tree for ornamental effect. As an example, a real tree may constitute any variety of tree that is grown on a farm or in a nursery, a tree found naturally in the forest or a potted tree at one's home or business.

Figure 1:
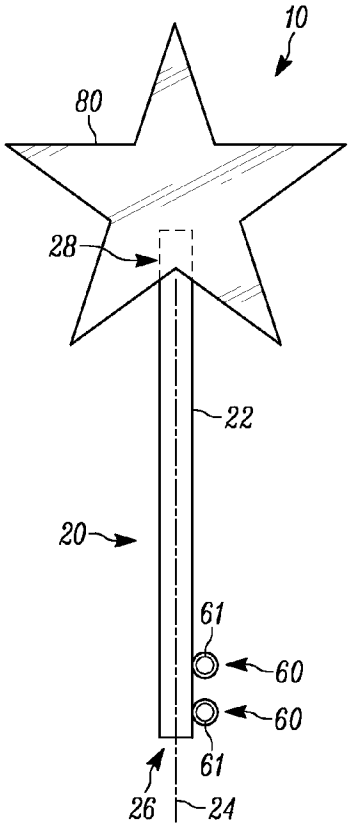
FIG. 1 illustrates an example of a tree topper apparatus configured to be secured to a tree top.

FIG. 1 illustrates an example of a tree topper apparatus 10. The apparatus 10 includes an elongated shaft 20 and an ornamental fixture 80. The elongated shaft 20 includes a body 22 that extends along a centerline (e.g., central longitudinal axis) 24 from a first or proximal end 26 to a second or distal end 28 from which the ornamental fixture 80 extends. The elongated shaft 20 can be formed of a substantially rigid material, such as plastic or metal. As an example, the shaft 20 can have a length of, for example, about 12 inches to about 36 inches. The length of the elongated shaft 20 varies depending on the height of the tree topper and the size and type of tree on which the tree topper apparatus 10 is used.

The body 22 can be defined by a cross-sectional geometric shape about the centerline 24, e.g., circular, square, triangular, or the like. Further, in some examples, the body 22 can have a uniform or varying thickness/circumference from the proximal end 26 to the distal end 28. The elongated shaft 20 can be formed or painted to exhibit a desired color such as, for example, the green color of the tree or brown color of the tree trunk.

In the example illustrated in FIG. 1, that apparatus 10 includes one or more connectors 60 located near the proximal end 26 of the body 22 of the elongated shaft 20 for helping to secure the apparatus 10 to the tree. As illustrated, the connectors 60 can include one or more openings 61. The openings 61 may constitute passages extending entirely through tabs or extensions of the body 22, or the openings may be in the form of loops, notches or hooks secured to or formed integrally with the body 22. Although a series of openings 61 are illustrated in the example of FIG. 1, it will be appreciated that other fastening structures, e.g., ribs, ridges, Velcro®, clasps or the like, may be provided along the length of the elongated shaft 20 to help secure the apparatus 10 to a tree.

In some examples, the connectors 60 can extend in a direction that is offset from, i.e., does not intersect, the centerline 24 of the body 22. Alternatively, the connectors 60 could extend through and intersect with the centerline 24 of the shaft 20. The connectors 60 thus can include openings positioned at spaced apart axial locations along the length of the shaft 20. As shown in the example of FIG. 1, connectors 60 are provided near the proximal end 26 of the elongated shaft 20, and additional openings can be positioned along the length of the body 22. The connectors 60 may have any spatial configuration about the body 22 of the elongated shaft 20. For example, the connectors 60 may be positioned on one side of the centerline 24 of the body 22 and axially spaced apart. In another example, the connectors 60 may be circumferentially spaced about the centerline in a random or predetermined pattern. The connectors 60 may be positioned in substantially the same plane (e.g., at a common axial position of the shaft)

or in different planes (e.g., spaced axially apart). The connectors 60 can have the same size or may have different sizes.

Although FIG. 1 represents an example embodiment of a tree topper apparatus 10, due to the wide variety of ornamental configurations, the illustrated configuration and dimensions of the ornamental fixture 80 relative to the elongated shaft 20 is only one possible example. For example, the ornamental fixture 80 is depicted as a star, which can be several times wider (e.g., 10-50 times wider) than the elongated shaft 20, which can vary depending on the specific application and desired effect. As a further example, the elongated shaft 20 can range in width, diameter, and/or thickness from about 0.1 inch to about 1 inch depending on the type of shaft and selected tree topper and the material properties of the shaft. Additionally, while the shaft 20 is attached at a center portion of a lower edge of tree topper, in other examples, the shaft could be attached near or at an edge of the tree topper. Moreover, since trees come in a variety of sizes, the ornamental fixture 80 can likewise come in a variety of sizes suitable for mounting atop such trees, including indoor and outdoor usage.

Figure 2:
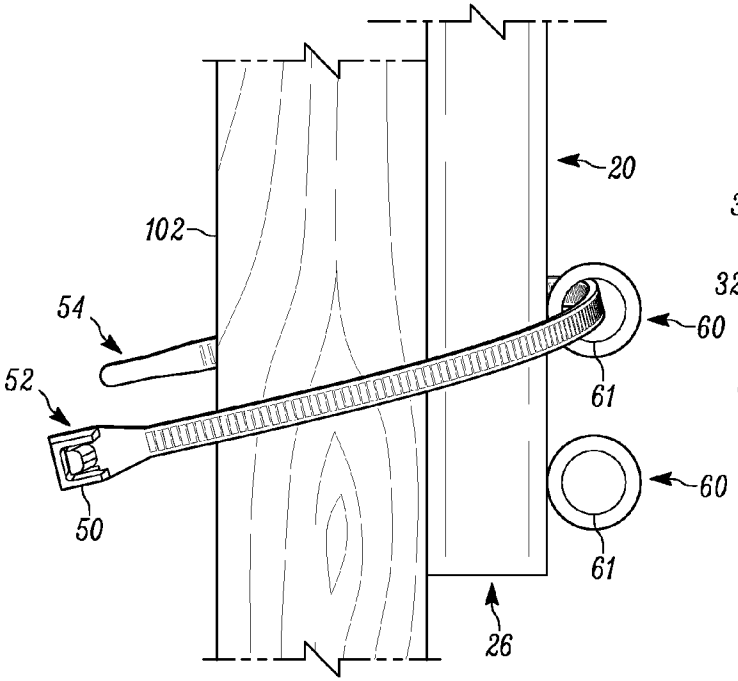
FIG. 2 illustrates an example of the apparatus of FIG. 1 being secured to a tree.

FIG. 2 illustrates an example of one or more fasteners 50 for securing the apparatus 10 of FIG. 1 to a tree branch 102. The tree branch 102, as described herein, can include but is not limited to a central trunk of a tree, a central pole of a manufactured tree, a limb extending from the trunk of a tree, or any appendage or fixture to which the shaft 20 can be secured. In FIG. 2, the proximal end 26 of the shaft 20 is placed against the tree branch 102, such that the proximal end 26 of the shaft that includes connectors 60 engages the branch 102 and the distal end 28 of the shaft is at or extends above the top of the tree for supporting the tree topper (not shown in FIG. 2) in a desired position relative to the tree. The elongated shaft 20 can be adjusted relative to a top 104 of the tree to a desired position depending on the style, shape, and weight of the tree topper. One or more fasteners 50 can be used to secure the apparatus 10 to the tree trunk 102. The fasteners 50 can constitute zip ties, as shown, but may alternatively include other types of fasteners such as wires or twisty-ties, clips, clamps, hook and loop fasteners Velcro® or the like. In any case, the fasteners 50 can be configured to provide a secure connection between the elongated shaft 20 and the tree for supporting the tree topper at the desired position.

In the example of FIG. 2, the fasteners (e.g., zip ties) 50 which include a head portion 52 and a tape portion 54. The tape 54 is fed through one or more openings 61 of the connectors 60, extend around (e.g., circumscribe) the branch 102 of the tree 100, and are fastened to the head 52 in order to secure the elongated shaft 20 to the tree. Each connector 60 used may receive a single fastener 50 or multiple fasteners. In one example, two or more zip ties 50 and two connectors 60 can be used to ensure a secure attachment between the elongated shaft 20 and the tree trunk 102. In the case of zip ties as the fasteners 50, once the zip ties are secure, the excess length of the ends of each zip tie can be trimmed off by using a pair of scissors, nail clippers or the like (not shown).

Figure 3:
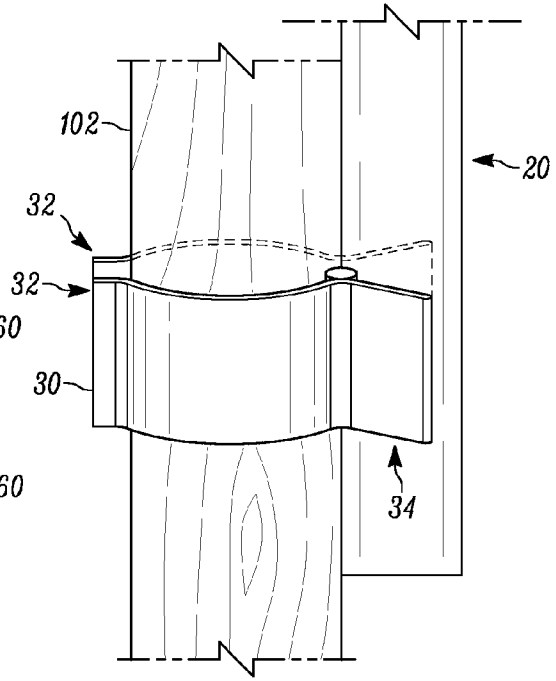
FIG. 3 illustrates another example of the apparatus of FIG. 1 being secured to a tree.

FIG. 3 illustrates another example of a connector in the form of a clip for securing the apparatus 10 to a tree trunk 102. In FIG. 3, the clip 30 is fixed at the proximal end of the shaft 20, such as by a permanent adhesive, welding or the like. The clip 30 includes one or a pair of jaw members 32 biased (e.g., by a spring) to a closed position. The jaw members 32 can be separated apart by application of force to one or more handles 34 associated with the one or more jaw members 32 to provide an opening between the jaw members 32 sufficiently sized to receive the branch 102 therein. For example, once the clip 30 is opened and the elongated shaft 20 is placed against the tree branch 102, the clip 30 can be released to automatically cause the jaws to return to the closed position with the branch therein extending between the jaw members 32. The force applied by biasing the jaw member 32 toward each other can thus secure the apparatus to the tree branch 102 for supporting the tree topper at the desired position.

Figure 5:
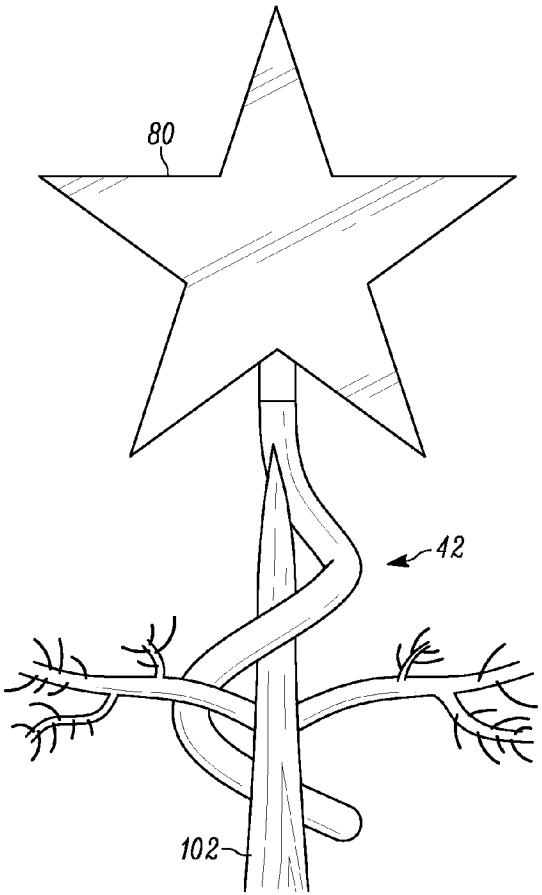
FIG. 5 illustrates an example of the apparatus of FIG. 4 being secured to a tree.
Figure 4:
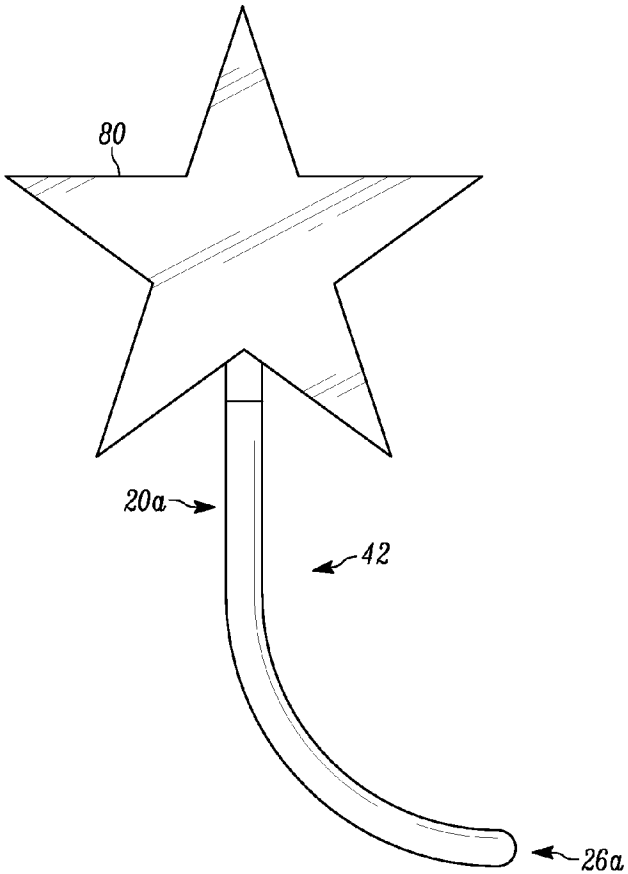
FIG. 4 illustrates an alternative example of a tree topper apparatus.

Another example of an elongated shaft **20*a* is illustrated in FIGS. 4-5. Features in FIGS. 4-5 that are the same as features in FIGS. 1-3 are given the same reference numeral whereas features in FIGS. 4-5 that are different from features in FIGS. 1-3 are given the suffix "a". In FIG. 4, the body 22*a* of the shaft 20*a* is formed as having one or more legs 42 (i.e., extensions) that extend longitudinally from the ornamental fixture 80. Although the body 22*a* is depicted as including a single leg 42 in the example of FIGS. 4-5, more than one leg, for example three legs, can be employed to secure the apparatus to the tree. For the example of multiple legs extending from the ornamental fixture 80, the legs 42 may be of equal length or of different lengths. Each leg 42** can have a length and be sufficiently wide to be easily manipulated by a users hand.

The legs 42 can be formed by an inelastically deformable material such as to allow the elongated shaft **20*a* to be deformed or bent in to a desired shape and then maintain such shape to enable attachment to a tree branch or other structure. For example, each leg 42 can be constructed of a continuously flexible and bendable solid core material, such as one or more wires or cables. In some examples, a sheath (e.g., covering) of a flexible and pliable material can enclose the flexible core material, such as to provide the shaft 20*a*** with a non-slip or slip-resistant exterior. For instance, the outer sheath can be formed of a foam rubber, a plastic, nylon, or a combination thereof.

As illustrated in FIG. 5, one or the legs 42, corresponding to the shaft **20*a*, can be shaped, e.g., bent, at one or more points along the body 22*a*. The shaft 20*a* thus can be manipulated by a user's hand to a desired shape of that can correspond to the configuration of a top of a tree, such as a tree branch 102. That is, an internal edge of the leg 42 can be urged against as each such leg is wrapped around one or more branches 102 of the tree. In this way, the leg 42 can be secured to the tree at a desired position, thereby ensuring the ornamental fixture 80 maintains a desired orientation (e.g., upward) when attached to the elongated shaft 20*a***.

In some examples, the ornamental fixture 80 is permanent affixed to and extends from the distal end 28 of the shaft **20/20*a*. For instance, the ornamental fixture 80 can be fixed to the elongated shaft 20** with an adhesive, by welding, by a non-releasable connection, or can be formed as a single, integrated unit, e.g., by injection molding the topper and shaft as a monolithic (e.g., integral) structure.

Figure 8:
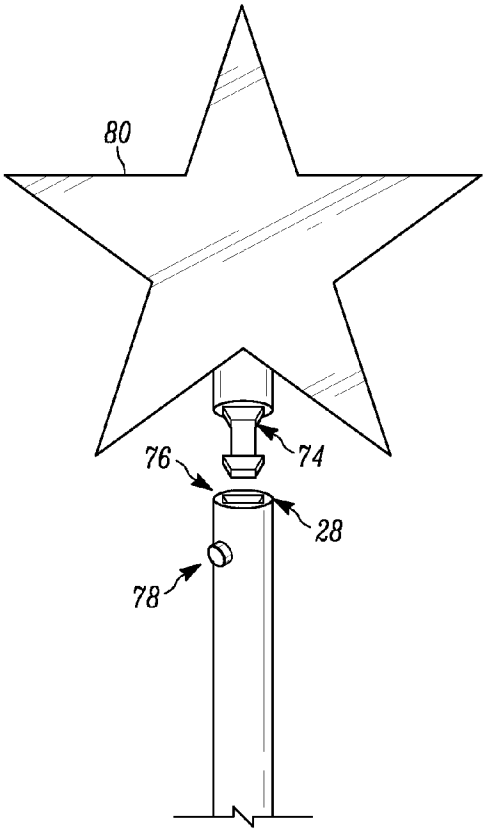
FIG. 8 illustrates another alternative example of a tree topper apparatus showing part of the apparatus that can be releasably connected to another part of the apparatus.
Figure 7:
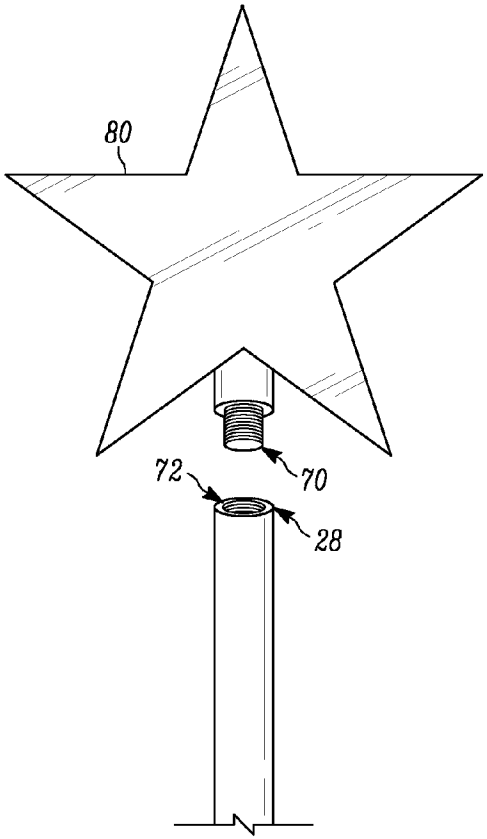
FIG. 7 illustrates an alternative example of a tree topper apparatus showing part of the apparatus that can be releasably connected to another part of the apparatus.
Figure 6:
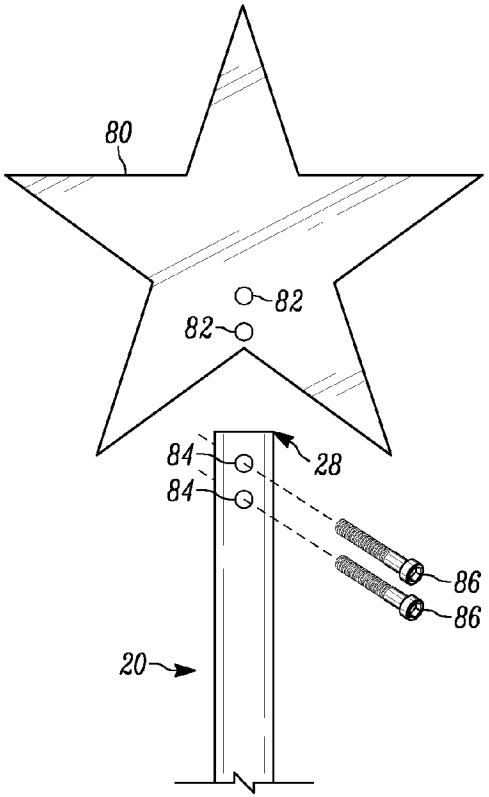
FIG. 6 illustrates an exploded view of a tree topper apparatus showing part of the apparatus that can be releasably connected to another part of the apparatus.

In other examples disclosed herein, the ornamental fixture 80 may be removable from the distal end 28 of the shaft **20*a*, such as demonstrated in the examples of FIGS. 6, 7 and 8. In examples where the tree topper is releasably connected from the shaft 20/20*a*, the topper can be secured to the shaft a top the tree before or after the shaft is secured to the tree, such as according to approaches of FIGS. 2-5. Since the ornamental fixture 80 is removable, one tree topper may be detached from the shaft 20/20*a*, such as after the elongated shaft 20 is secured to the tree trunk 102**, and another different tree topper (not shown) may be attached in its place. Thus, a user can switch between any number of different tree toppers by switching out ornamental fixtures without removing the shaft from the tree. In one example, a set of plural ornamental fixture can exhibit a Christmas theme, such as including a star, a cross, an angel, letters or numbers, a figurine (e.g., animal or person) or the like.

In the example of FIG. 6, the ornamental fixture 80 can be releasably connected to the elongated shaft 20 so that the force needed to separate the components does not result in plastically deforming them. For example, the ornamental fixture 80 and elongated shaft 20 can be configured with a series of holes 82, 84, respectively, aligned in a manner suitable for accepting one or more fasteners 86, such as elongated pins, wires, twisty-ties, bolts, or the like.

As illustrated in the example of FIG. 7, the ornamental fixture 80 can include threads (e.g., internal or external screw threads) for mating attachment with corresponding threads (e.g., external or internal screw threads) of the shaft 20/20*a*. In the example of FIG. 7, the ornamental fixture 80 includes an externally threaded shaft 70 configured for mating insertion into a threaded receptacle 72 at the distal end 28 of the elongated shaft 20. For example, protuberance 70 can be threaded as a screw, and the connector 72 can include internal threads as a nut by which the ornamental fixture 80 can be releasably attached.

FIG. 8 illustrates example of another means that can be utilized for attaching the ornamental fixture 80 to the shaft. In the example of FIG. 8, the tree topper includes a protuberance 74, such as can be configured as a pin, and the attachment component 76 as a mating receptacle (e.g., a socket) configured for receiving the protuberance 74. The protuberance 74, such as can be configured as a pin, and the attachment component 76 can attach together via the ornamental fixture 80 by a variety of ways, including friction, use of a spline, by snap-fit, magnets, or other suitable connections to hold the tree topper and the shaft together. As yet another example, the attachment component 76 can include a releasable spring-loaded clip biased inward to secure the inserted protuberance 74. The protuberance 74 and the attachment component 76 can be configured as a male extension and a female socket, respectively. When the male extension is mated with the female socket, the spring-loaded clip secures the ornamental fixture to the shaft. Once mated, a release tab 78 can be configured to bias the spring-loaded clip outward, as to allow for removal of the protuberance 74 from the attachment component 76. Moreover, the shaft can be configured to accommodate multiple height positions for the ornamental fixture 80. In other words, the release tab 78 can allow for the spring loaded clip of the attachment component 76 to adjust the position of the protuberance 74 relative to the shaft.

Additionally, two or more ornamental fixtures 80 can be attached to the elongated shaft 20. For example, one or more attachment components can be located radially about the circumference of the elongated shaft 20 at the distal end 26 in addition to the attachment components 72. Thus, one or more ornamental fixtures 80 can be attached extending radially outward from the elongated shaft 20, and another ornamental fixture 80 can be extending outward about the centerline 24*a* of the body 22*a*. In this manner, one or more ornamental fixtures 80 can be attached to the body 22*a* in a substantially upward or sideways orientation.

For each of the examples disclosed herein, the tree topper apparatus 10 can be configured for electrical operation, such as based on DC power supplied by batteries, solar power or be powered from a connection to an AC power source. For instance, the ornamental fixture 80 can include one or more light bulbs to provide illumination. Additionally or alternatively, the tree topper apparatus 10 can be configured to exhibit movement in response to the electrical power. Such movement can include rotation of the ornamental fixture about an axis or one or more elements of the topper can be moveable. For example, the shaft can include a motor having a shaft aligned substantially parallel to the axis 24 for rotating the ornamental fixture when turned on. In examples where the topper is removable from the shaft (e.g., such as disclosed with respect to FIGS. 6-8), connection between the ornamental fixture and the shaft can create an electrical connection for providing electrical power to the topper. For instance, the ornamental fixture 80 and shaft 20/20*a* can include respective mating contacts that provide an electrical circuit path when connected.

What have been described above are examples. It is, of course, not possible to describe every conceivable combination of structures, components, or methods, but one of ordinary skill in the art will recognize that many further combinations and permutations are possible. Accordingly, the invention is intended to embrace all such alterations, modifications, and variations that fall within the scope of this application, including the appended claims. Where the disclosure or claims recite "a," "an," "a first," or "another" element, or the equivalent thereof, it should be interpreted to include one or more than one such element, neither requiring nor excluding two or more such elements. As used herein, the term "includes" means includes but not limited to, and the term "including" means including but not limited to. The term "based on" means based at least in part on.

What is claimed is:

1. An apparatus comprising:

an elongated shaft having a distal end and a proximal end;

an ornamental fixture attached to and extending outwardly from the distal end of the elongated shaft, wherein the distal end of the elongated shaft includes a snap-fit slot dimensioned and configured to receive a mating protuberance extending from the ornamental fixture; and a connector at the proximal end of the elongated shaft configured to secure the elongated shaft to a tree.

2. The apparatus recited in claim 1, wherein the ornamental fixture is removably connected to the elongated shaft.

3. The apparatus recited in claim 2, wherein the ornamental fixture is attached to the elongated shaft by one of a zip-tie, a wire, a clip, a clamp, a bolt, a pin and a twist-tie.

4. The apparatus recited in claim 1, wherein the connector further comprises at least one of a zip-tie, a wire, a clip, a clamp, and a twist-tie.

5. A method of using the apparatus of claim 1, the method comprising:

placing the distal end of the elongated shaft and the connector adjacent a branch of the tree; and attaching the connector to the branch of the tree to secure the ornamental fixture at a desired position relative to a top of the tree.

6. The method recited in claim 5, wherein the ornamental fixture is removably connected to the elongated shaft, the method further comprising:

removing the ornamental fixture from the elongated shaft; and attaching another ornamental fixture to the elongated shaft.

7. The method of claim 6, wherein the other ornamental fixture is attached to the elongated shaft while the elongated shaft remains attached to the tree.

8. A method of positioning a tree topper on a tree, the method comprising:

providing an elongated shaft that includes a distal end and a proximal end spaced apart from each other by an elongated body, one or more connectors located adjacent the proximal end of the elongated shaft, and an ornamental fixture extending from the distal end of the elongated shaft, wherein the distal end of the elongated shaft includes a snap-fit slot shaped to cooperate with a mating protuberance extending from the ornamental fixture;

placing the proximal end of the elongated shaft adjacent at least one branch of the tree; and securing the elongated shaft to the tree employing the one or more connectors.

9. The method of claim 8, wherein the ornamental fixture is removably connected to the distal end of the elongated shaft, the method further comprising attaching the ornamental fixture to the shaft employing the snap-fit slot and the mating protuberance.

10. The method of claim 9, further comprising:

removing the ornamental fixture from the elongated shaft; and attaching another ornamental fixture to the elongated shaft to extend outwardly from the top of the tree.

11. The method of claim 8, wherein the tree is one of an artificial tree or a real tree.

* * * * *